US010458108B2

(12) United States Patent
Gann

(10) Patent No.: US 10,458,108 B2
(45) Date of Patent: Oct. 29, 2019

(54) DUAL-BOWL TOILET

(71) Applicant: Michael Lawrence Gann, Blue Lake, CA (US)

(72) Inventor: Michael Lawrence Gann, Blue Lake, CA (US)

( * ) Notice: Subject to any disclaimer, the term of this patent is extended or adjusted under 35 U.S.C. 154(b) by 147 days.

(21) Appl. No.: 15/456,056

(22) Filed: Mar. 10, 2017

(65) Prior Publication Data

US 2017/0260733 A1 Sep. 14, 2017

Related U.S. Application Data

(60) Provisional application No. 62/307,274, filed on Mar. 11, 2016.

(51) Int. Cl.

| | |
|---|---|
| ***E03D 11/10*** | (2006.01) |
| ***E03D 5/08*** | (2006.01) |
| ***E03D 5/092*** | (2006.01) |
| ***E03D 9/08*** | (2006.01) |

(52) U.S. Cl.

CPC ..... *E03D 11/10* (2013.01); *E03D 5/08* (2013.01); *E03D 5/092* (2013.01); *E03D 9/08* (2013.01)

(58) Field of Classification Search

CPC ..... E03D 11/10
USPC ..... 4/425, 415, 300, 448, 315
See application file for complete search history.

(56) References Cited

U.S. PATENT DOCUMENTS

| | | | | |
|---|---|---|---|---|
| 1,017,044 A | | 2/1912 | Fraser | |
| 1,179,360 A | | 4/1916 | Ratcliffe W A | |
| 2,114,551 A | | 4/1938 | Winding B | |
| 3,638,244 A | * | 2/1972 | Schmid | E03D 5/016 4/317 |
| 4,535,491 A | * | 8/1985 | Young | E03D 9/00 4/300.3 |
| 5,321,857 A | | 6/1994 | Lataillade | |
| 5,689,840 A | * | 11/1997 | Kuhlman | A61G 9/003 4/450 |
| 2007/0011801 A1 | * | 1/2007 | DuBois | E03D 11/10 4/442 |
| 2008/0244819 A1 | | 10/2008 | Meador | |
| 2010/0242162 A1 | * | 9/2010 | Moon | E03C 1/298 4/420 |

* cited by examiner

*Primary Examiner* — Christine J Skubinna
(74) *Attorney, Agent, or Firm* — Donald R. Boys; Central Coast Patent Agency LLC

(57) ABSTRACT

A toilet has a first bowl connected via internal passages to a water tank having a hand-operable valve, one or more remotely-operable spray openings, directed upward, and a connected passage to a sewer line, and a second bowl, rotatable and joined to the first bowl, and operable by a lever in a manner that the second bowl maintains an upright position, or an inverted position facing downward into the first bowl, Urine or feces in the second bowl at a time of moving the lever from the first position to the second position, as the second bowl is moved to the inverted position, is dropped into the first bowl, the second bowl, inverted, is spray-cleaned by operation of the spray openings, and the cleaned second bowl is returned to upright position by moving the lever back to the first position.

12 Claims, 10 Drawing Sheets

DUAL-BOWL TOILET

CROSS-REFERENCE TO RELATED DOCUMENTS

The present patent application claims priority to provisional application 62/307,274, filed on Mar. 11, 2016, entitled, "Dual-Bowl Toilet". Disclosure of the priority applications is incorporated herein in its entirety by reference.

BACKGROUND OF THE INVENTION

1. Field of the Invention

The present invention is in the technical area of plumbing fixtures and apparatus, and pertains more particularly to a toilet having two nested bowls, and capable of maximum water savings.

2. Description of Related Art

Toilet fixtures are well-known in the art, and many have been optimized by their creators in ways to use less water than most conventional toilets use. The existing toilets, however, still use more water than might always be necessary, and there is a continuing need for better water savings.

BRIEF SUMMARY OF THE INVENTION

In an embodiment of the invention a dual-bowl toilet is provided, comprising a first bowl connected via one or more internal passages to a water tank having a hand-operable valve enabled to provide, when opened, water in the tank into the first bowl, one or more remotely-operable spray openings on and through an inner surface, directed upward, and a connected passage to a sewer line, and a second bowl, smaller than the first bowl, rotatable and joined to the first bowl, and operable by a lever in a manner that the second bowl maintains a resting, upright position with the lever in a first position, or an inverted position facing downward into the first bowl, with the lever moved to a second position, Urine or feces in the second bowl at a time of moving the lever from the first position to the second position, as the second bowl is moved to the inverted position, is dropped into the first bowl, the second bowl, inverted, is spray-cleaned by operation of the spray openings, and the cleaned second bowl is returned to upright position by moving the lever back to the first position.

In one embodiment, the second bowl is suspended within the first bowl, both in upright and inverted position. Also in one embodiment, the second bowl is pivoted along a pivot axis from front to back, has an upper rim enabled to seal to inside an upper region of the first bowl by seal elements on one or both of the upper rim and the upper region, and wherein a mechanical pivot mechanism operated by the lever moves the second bowl to unseal from the upper region of the first bowl as the lever is operated before inverting the second bowl, and moves the second bowl to reseal to the upper region of the first bowl as the second bowl is returned by the pivot mechanism to the upright position.

In one embodiment, the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl. Also in one embodiment, the second bowl is pivoted side-to-side and is operated by a lever to rotate the second bowl from an upright to an inverted position. And in one embodiment the toilet further comprises a hand-operable valve enabled to add a small volume of water to the second bowl when the second bowl is in an upright position.

In one embodiment, the lever is one or both of a foot-operated or a hand operated lever, operable from one side or both sides of the toilet, and in one embodiment the toilet further comprises a plunger opening implemented at an upper region of the first bowl, opening into inside the first bowl below the second bowl with the second bowl sealed to the first.

In another aspect of the invention, a method of conserving water use in a toilet is provided, comprising joining a second bowl rotatable and operable by a lever, to a first bowl connected via one or more internal passages to a water tank having a hand-operable valve enabled to provide, when opened, water in the tank into the first bowl, one or more remotely-operable spray openings on and through an inner surface, directed upward, and a connected passage to a sewer line, operating the lever from a first to a second position, moving the second bowl from a resting, upright position with the lever in a first position, to an inverted position facing downward into the first bowl, with the lever moved to a second position, causing urine or feces in the second bowl to drop into the first bowl, operating the spray openings with the second bowl inverted, to clean the second bowl, and returning the second bowl to the resting, upright position by returning the lever to the first position.

In one embodiment, the method further comprises rotating the second bowl suspended within the first bowl, both in upright and inverted position. Also in one embodiment, the method further comprises sealing the second bowl by an upper rim to an upper region of the first bowl with the second bowl upright, unsealing the first bowl from the second with action of a pivot mechanism before rotating the second bowl, and resealing the second bowl to the first bowl when the second bowl is returned to the upright position. In one embodiment, the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl. Also in one embodiment, the method further comprises pivoting the second bowl from side-to-side.

In one embodiment, the method further comprises adding a small volume of water to the second bowl when the second bowl is in an upright position, by a hand-operable valve. Also in one embodiment, the lever is implemented as one or both of a foot-operated or a hand operated lever, operable from one side or both sides of the toilet. And in one embodiment, the method further comprises plunging the toilet through the first bowl by a plunger opening implemented at an upper region of the first bowl, opening into inside the first bowl below the second bowl with the second bowl sealed to the first bowl.

DETAILED DESCRIPTION OF THE INVENTION

Figure 1:
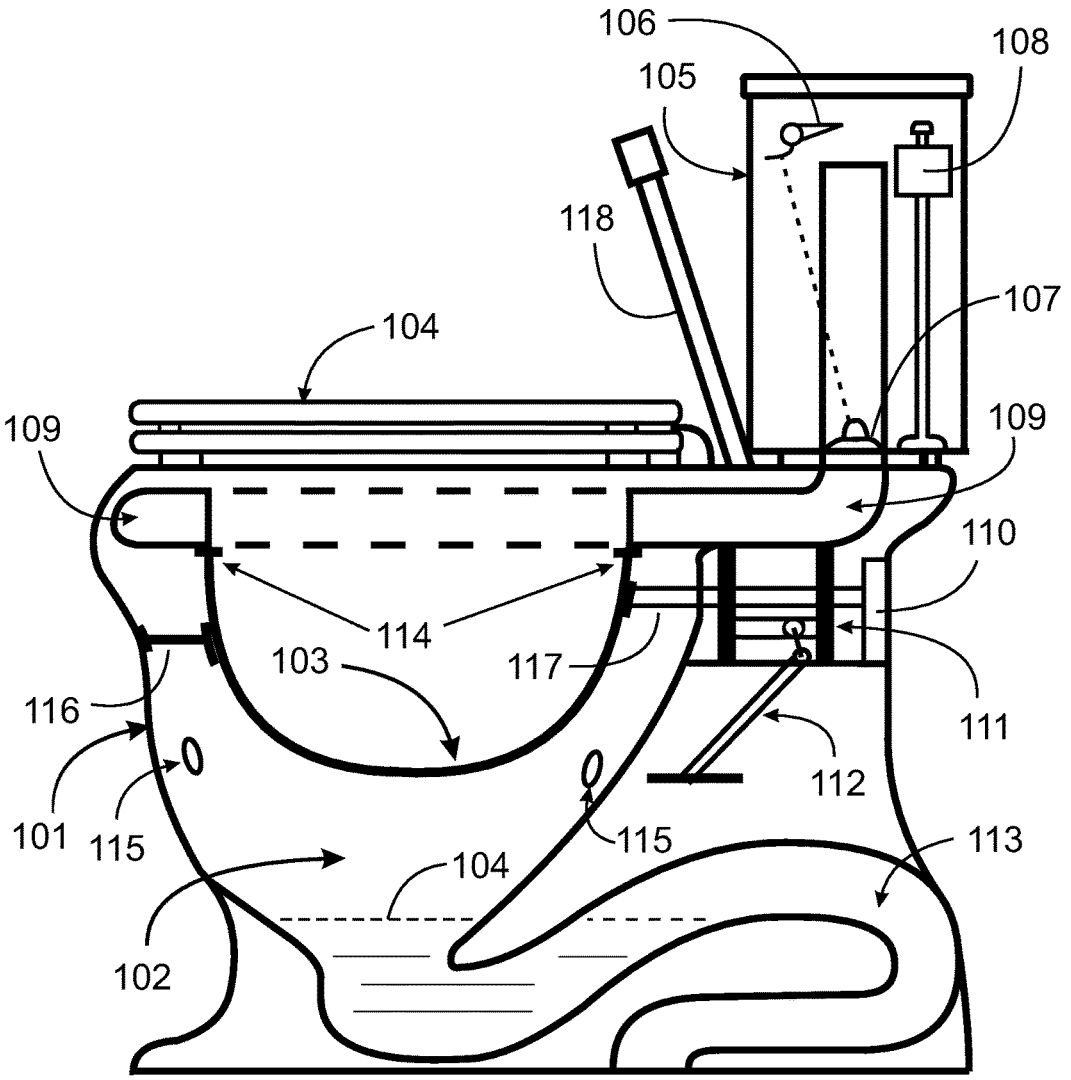
FIG. 1 is a side elevation view, partially in section, showing essential elements and relationships in an embodiment of the present invention.

FIG. 1 is a side elevation view, partially in section, showing essential elements and relationships of a toilet in an embodiment of the present invention. Internal elements are shown in this view in solid lines, which is not conventional representation in a section view, but it will be apparent to the skilled person which elements are internal, and which are not.

The toilet in embodiments of this invention has a rim with an internal passage 109 as in most conventional toilets, and passage 109, which proceeds around the entire circumference of the toilet, is connected to a water tank 105, as in most conventional toilets. A flapper valve 107 in this embodiment prevents water flowing in passage 109 until and unless the flapper valve is lifted by operation of a lever 106.

An essential difference in several embodiments of the present invention from conventional toilets is that the toilet shown in the embodiment illustrated by FIG. 1 has a rotatable inner bowl 103 nested within an outer bowl 102, which serves as a temporary holding tank for small amounts of waste. The inner bowl is pivoted at the front from the outer bowl by a pivot mechanism 116, and at the back by a pivot mechanism 117. The inner bowl seals in a closed (default) position to inside the upper rim of the outer bowl 102 at seal element 114. Seal element 114 may be a replaceable seal that may be implemented in a variety of ways. In one embodiment, inner bowl 103 has an elastomeric seal built into its upper rim, and this seal may be removed to be cleaned or replaced. In an alternative embodiment, the seal may be joined to the underside of the upper rim of the outer bowl. In some embodiments, there may be seal elements on both rims.

In one embodiment of the invention inner bowl 103 is enabled to rotate within outer bowl 103, and the rotation is managed by a linked and geared mechanism 111, which is operated by a foot lever 112, and made accessible through an access port 110. In some embodiments, operation may be by moving a hand lever 118, which is connected to mechanism 111 in the same way as the foot lever. In some embodiments, the dual-bowl toilet may have both a hand lever and a foot lever. In these implementations, the hand lever may be on the same side as the foot lever, and may connect to a common shaft that connects in mechanism 111. In other implementations, the hand lever may be on one side and the foot lever on the other as shown in the figures. In other implementations, only one of the two may be used, but it may be implemented on either side of the toilet.

Rotation of inner bowl 103 within outer bowl 102 can take place in most cases only by breaking the seal between the inner bowl and the upper rim of the outer bowl. In one embodiment, this is accomplished by mechanism 111 such that when foot lever 112 is operated mechanism 111 lowers pivot mechanism 117 before rotating inner bowl 103. Pivot 116 does not lower, but is gimbaled at the inner bowl so when pivot mechanism 117 is lowered, bowl 103 lowers enough on the front side to break the seal in the front with the upper rim of the outer bowl.

Figure 2:
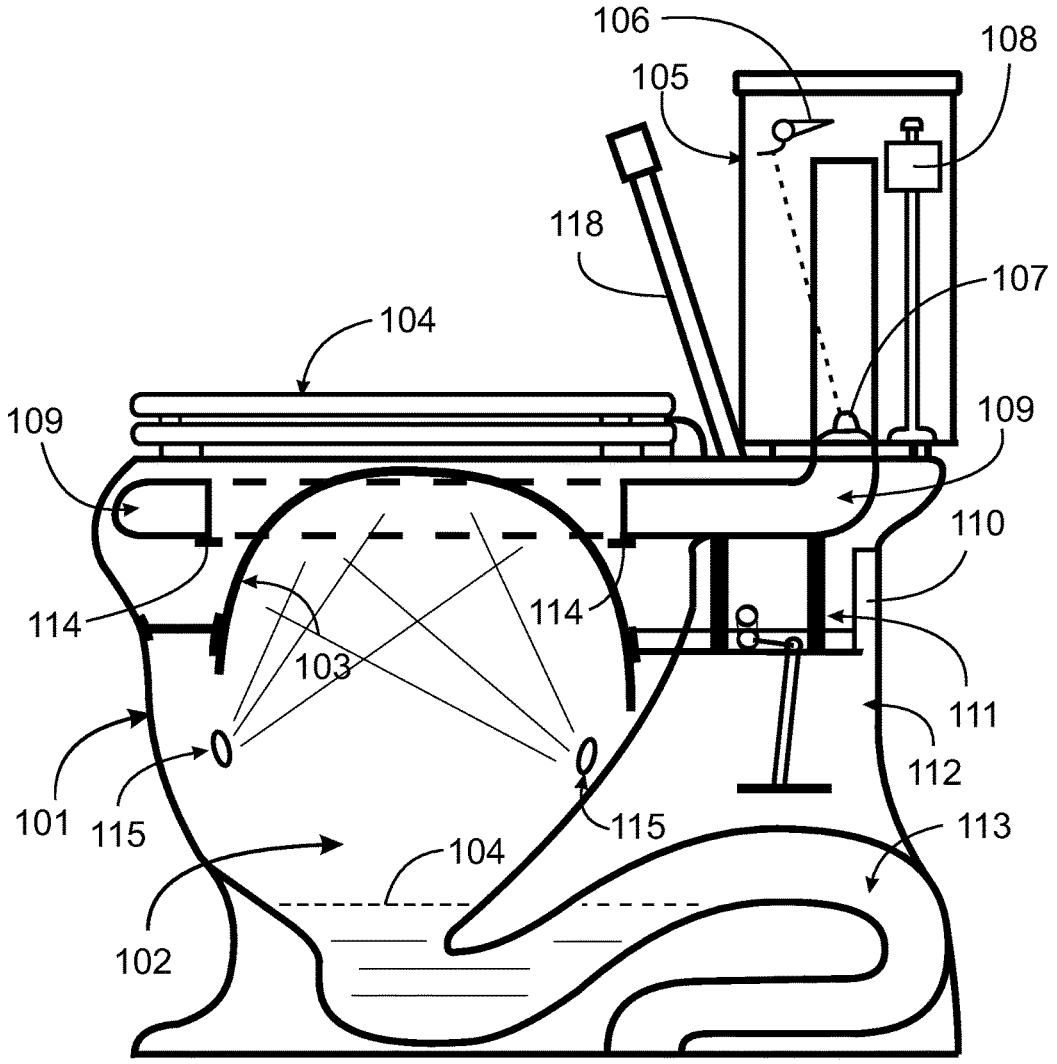
FIG. 2 is a side elevation view of the toilet of FIG. 1 illustrating element operation in one embodiment of the invention.

Once the seal is broken, inner bowl 103 is rotated 180 degrees to an inverted position as seen in FIG. 2. In this inverted position, any fecal or urinary material in bowl 103 will be dropped into water 104 in the bottom of outer bowl 102. Addition of any material from inner bowl 103 will typically cause at least some expulsion of water 104 through passage 113 into a connected sewer or septic system. There are spray jets 115 in the inner surface of the outer bowl, which spray water upward into inverted inner bowl 103 for the purpose of rinsing any urine or fecal matter that might otherwise adhere to the surface. These spray jets in one embodiment are triggered automatically for a fixed time period while the inner bowl is inverted. When the inner bowl begins to return to its suspended position sealed to the upper rim of the outer bowl, the spray jets close. In one embodiment, a manual override is provided for additional spraying time.

Figure 3:
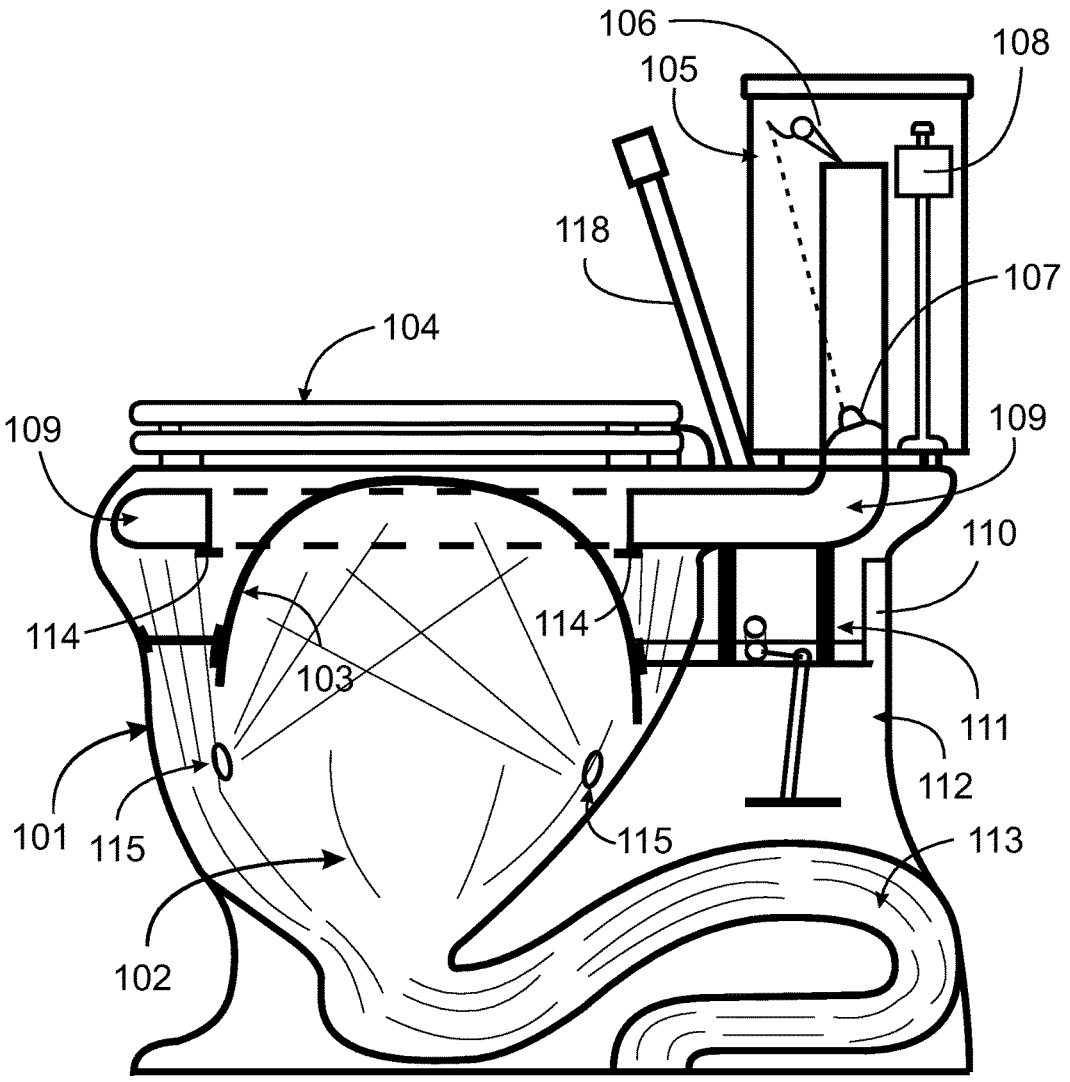
FIG. 3 is a side elevation view of the toilet of FIG. 1 and FIG. 2 illustrating element operation in another aspect of the invention.

In one aspect, either with inner bowl 103 inverted, or not inverted, one may operate lever 106, raising flap valve 107, as shown in FIG. 3, and empty tank 105 through passage 109, down the inner walls of outer bowl 102, flushing whatever may be in the bottom of outer bowl 102 into the sewer or septic system. When the flush finishes and lever 106 is released, tank 105 refills and stops by a float valve 108, as in conventional apparatus.

Figure 4:
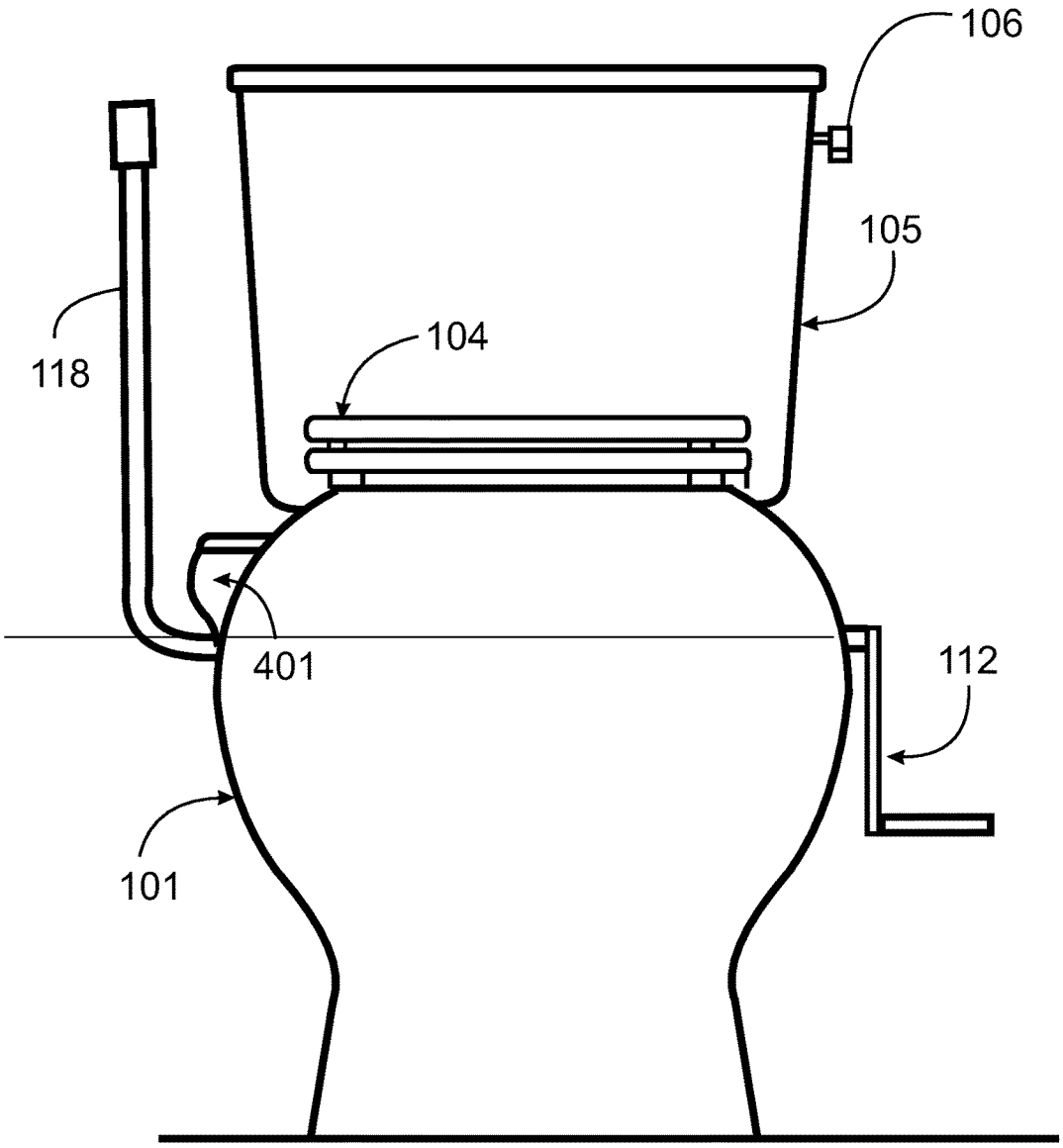
FIG. 4 is a front view of the toilet of FIGS. 1-3.
Figure 5:
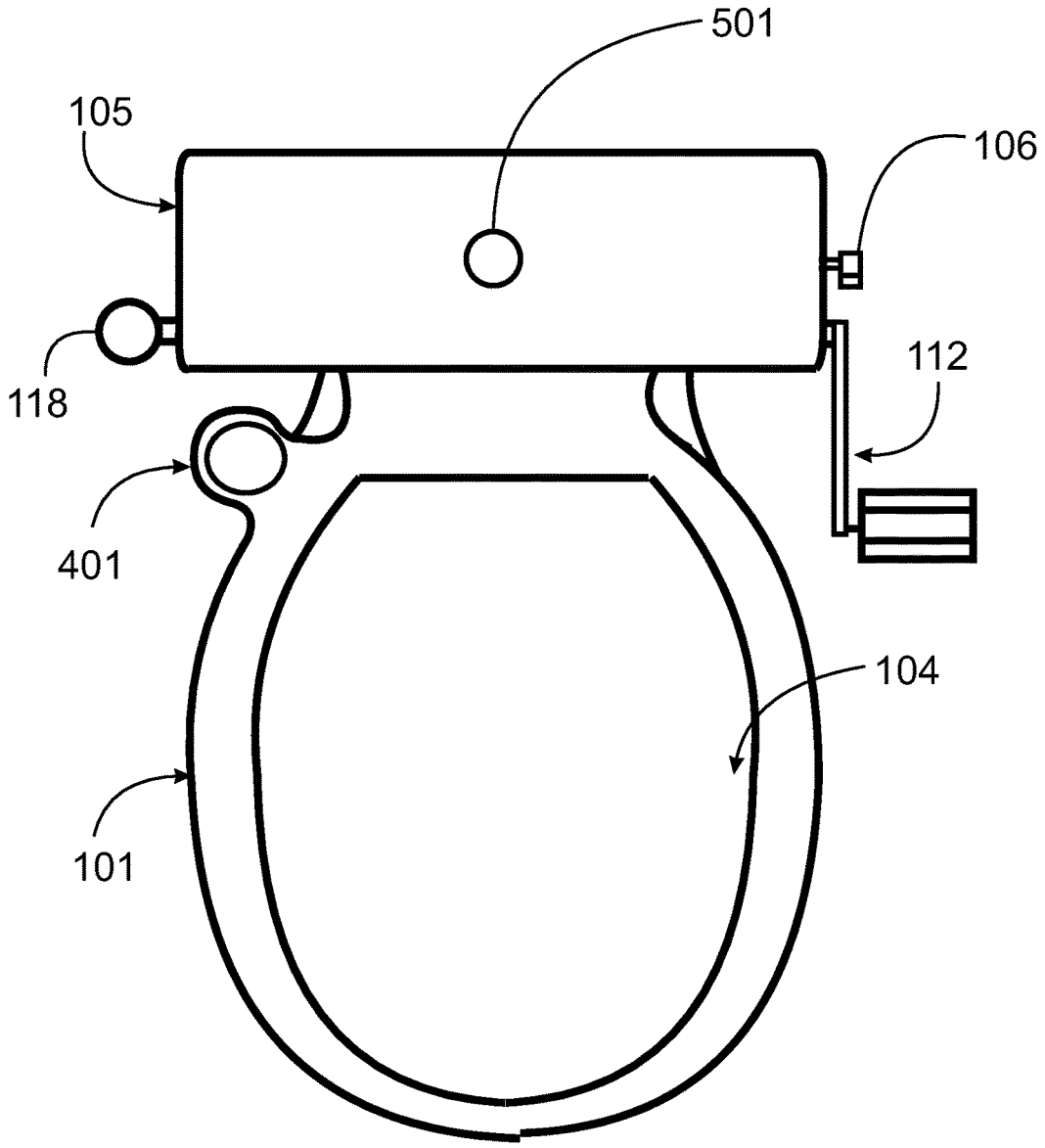
FIG. 5 is a top-down view of the toilet of FIGS. 1-4.

FIG. 4 is a front elevation view of the toilet of FIGS. 1-3, showing a view and plunger opening 401, where one may apply a plunger, with the inner bowl sealed to the outer, to force open a plugged passage 113. FIG. 5 is a top plan view of the toilet of FIGS. 1-4.

A theory of operation of the toilet illustrated in FIG. 1-5 and described in enabling detail above is that when only passage of urine is to be accomplished, it is not necessary to flush the toilet with the water in tank 105. One may simply pass urine with the inner bowl in the closed and sealed position, operate foot lever 112 to rotate and rinse the bowl, and then release foot lever 112 to allow the inner bowl to return upright and seal to the outer bowl. The amount of water sprayed in this operation is very, very small compared to flushing the toilet by lever 106, emptying tank 105 into the sewer or septic system.

In multiple passages of urine and operation of the foot lever, urine will be added each time to water 104 in the bottom of outer bowl 102, but the seal 114 is reasserted after each operation, and odor is therefore controlled. After a user passing feces, operation of the foot lever will drop the fecal matter, and any accompanying urine, to the bottom of outer bowl 102 into water 104. Releasing the foot lever 112 will allow the inner bowl, rinsed, to return to upright and seal. Then it is up to the user whether to operate lever 106 for a conventional flush. Some users may be more dedicated to saving water, and may establish longer periods between what the inventor terms a Small Flush and a Big Flush. Some users will use a Big Flush only for each passage of fecal matter.

In any case, the amount of water entering the sewer or septic system will be far less on a daily basis than the usual practice of a Big Flush with every use of the toilet.

In an alternative embodiment of the invention a fill valve 501 may be operated with the inner bowl upright and sealed if a user contemplates passing fecal matter. Operation of fill valve 501 introduces a small amount of water into the bottom of the inner bowl, to minimize adhesion of fecal matter to the inner surface of the inner bowl, which might require more spray from jets 115 that would otherwise be needed.

Also in one embodiment of the invention a hand crank 402, as illustrated in FIGS. 4 and 5, might be provided and used in lieu of foot pedal 112 for inverting inner bowl 103. In some embodiment both the foot pedal and the hand crank might be implemented.

Figure 6:
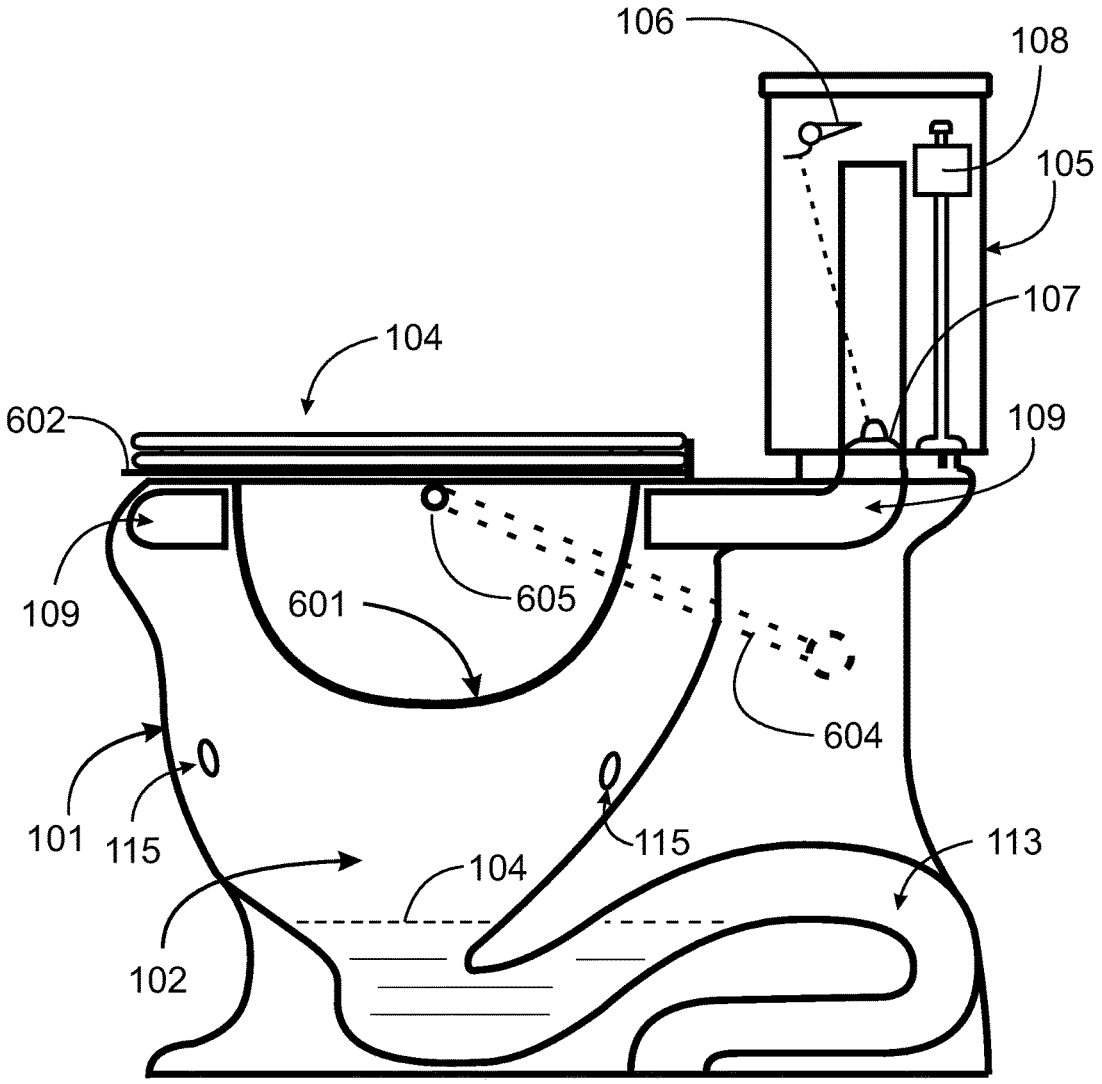
FIG. 6 is a side elevation view of a dual-bowel toilet in another embodiment of the invention.

FIG. 6 is a side elevation view of a dual-bowl toilet in an alternative embodiment of the invention. In FIG. 6 there are many common elements with the toilet of FIGS. 1-5, and these elements bear the element numbers assigned in those figures. New elements are numbered accordingly.

In the embodiment illustrated in FIG. 6 there is still an outer bowl 102 and an inner bowl, now element 601, but inner bowl 601 is pivoted and operated differently than bowl 103 described above with reference to FIGS. 1-5. Inner bowl 601 is pivoted on an axis 605 on the sides of toilet 101 rather than at the front and the back, as for the bowl in FIGS. 1-5. A hand lever 604 is affixed to pivot 605 such that moving hand lever 604 180 degrees causes bowl 601 to invert. In this implementation hand lever 604 is on the back side of the toilet from the view of FIG. 6, so shown in dotted lines.

Figure 7:
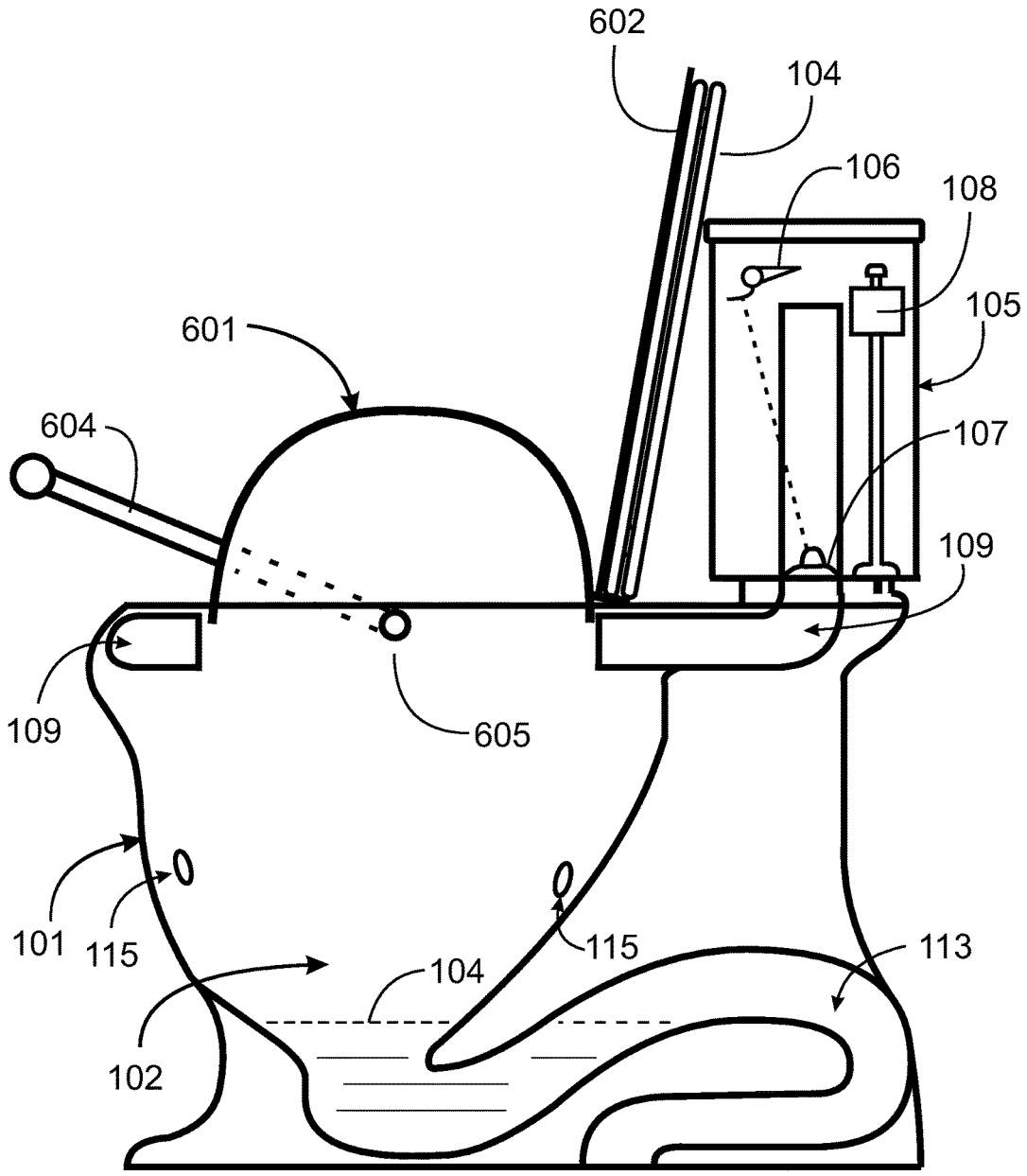
FIG. 7 is a side elevation view of the toilet of FIG. 6 showing elements in operation.

FIG. 7 is a side elevation view of the toilet of FIG. 6 showing bowl 601 inverted with hand lever 604 moved 180 degrees. Referring again to FIG. 6, there is a special seal ring 602 hinged along with the toilet seat and cover 104. This seal ring, when closed upon the top of the ceramic bowl, below the toilet seat and cover 104, seals to both the ceramic bowl at the top, and to the rim of bowl 601, so when bowl 601 is in the lower position, there is an effective seal between the inner bowl and the upper rim of the outer bowl.

The purpose of the inner bowl and the outer bowl is essentially the same for both of the implementations described, but the operation is somewhat different. For the toilet of FIGS. 6 and 7, use of the toilet is with the cover up and the toilet seat down, and seal ring 602 down in place. When the user has urinated or defecated in the inner bowl, the user raises the toilet seat and the seal ring 602, which unseals the inner bowl. The user then moves arm 604 inverting bowl 601 as seen in FIG. 7. In the inverted position urine or fecal material drops into the outer bowl and spray jets 115 rinse the inner bowl in the inverted position. The user may then move hand lever 604 to revert bowl 601 to the upright position as shown in FIG. 6. The user may then lower seal ring 602 over the rim of the toilet and the rim of inner bowl 601 to reseal.

Small flush and Big flush work just as described before for the first implementation illustrated in FIGS. 1-5. Further, button 501 is still useful to provide a small amount of water into inner bowl 601.

Figure 8:
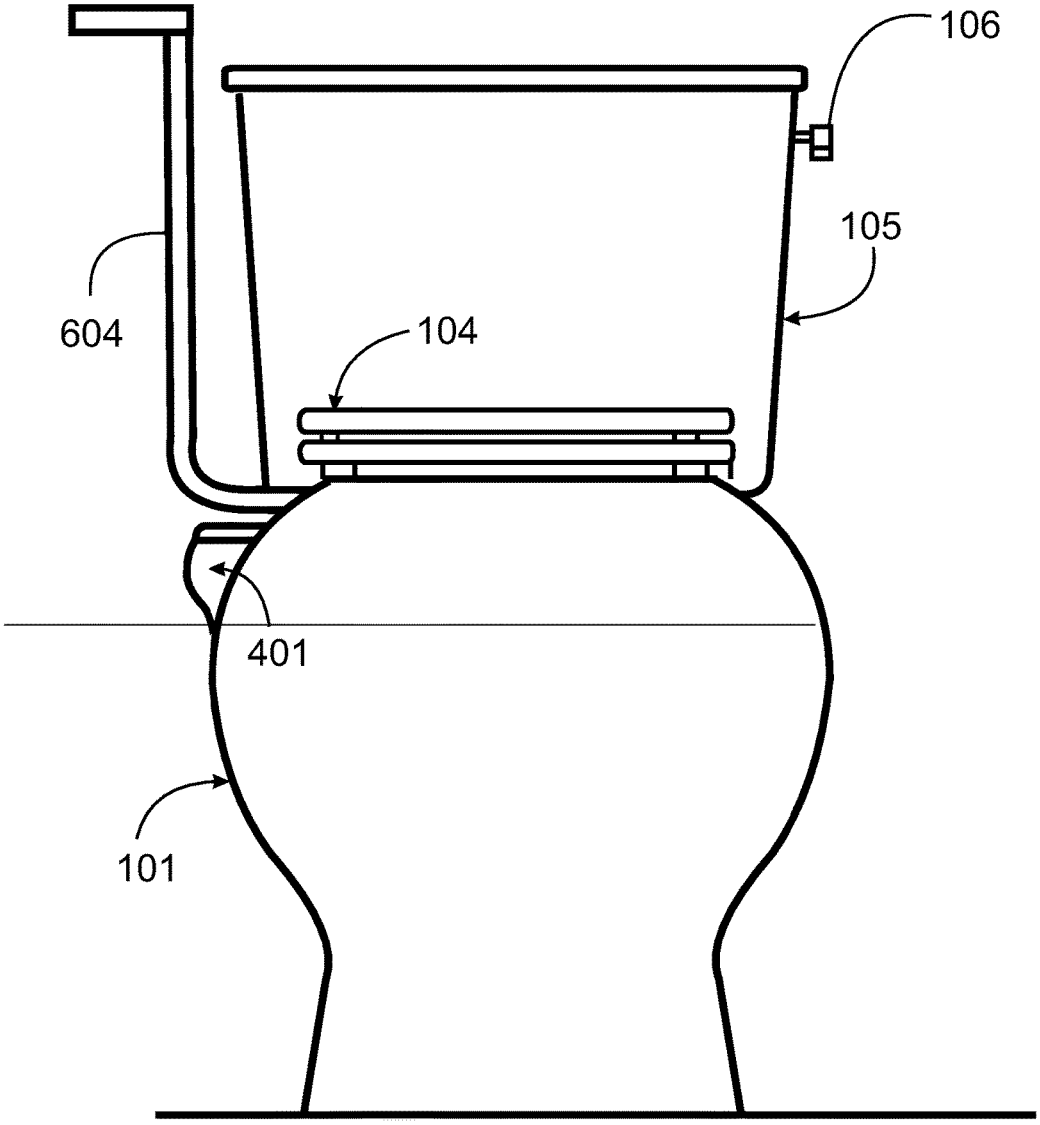
FIG. 8 is a front elevation view of the toilet of FIGS. 6 and 7.
Figure 9:
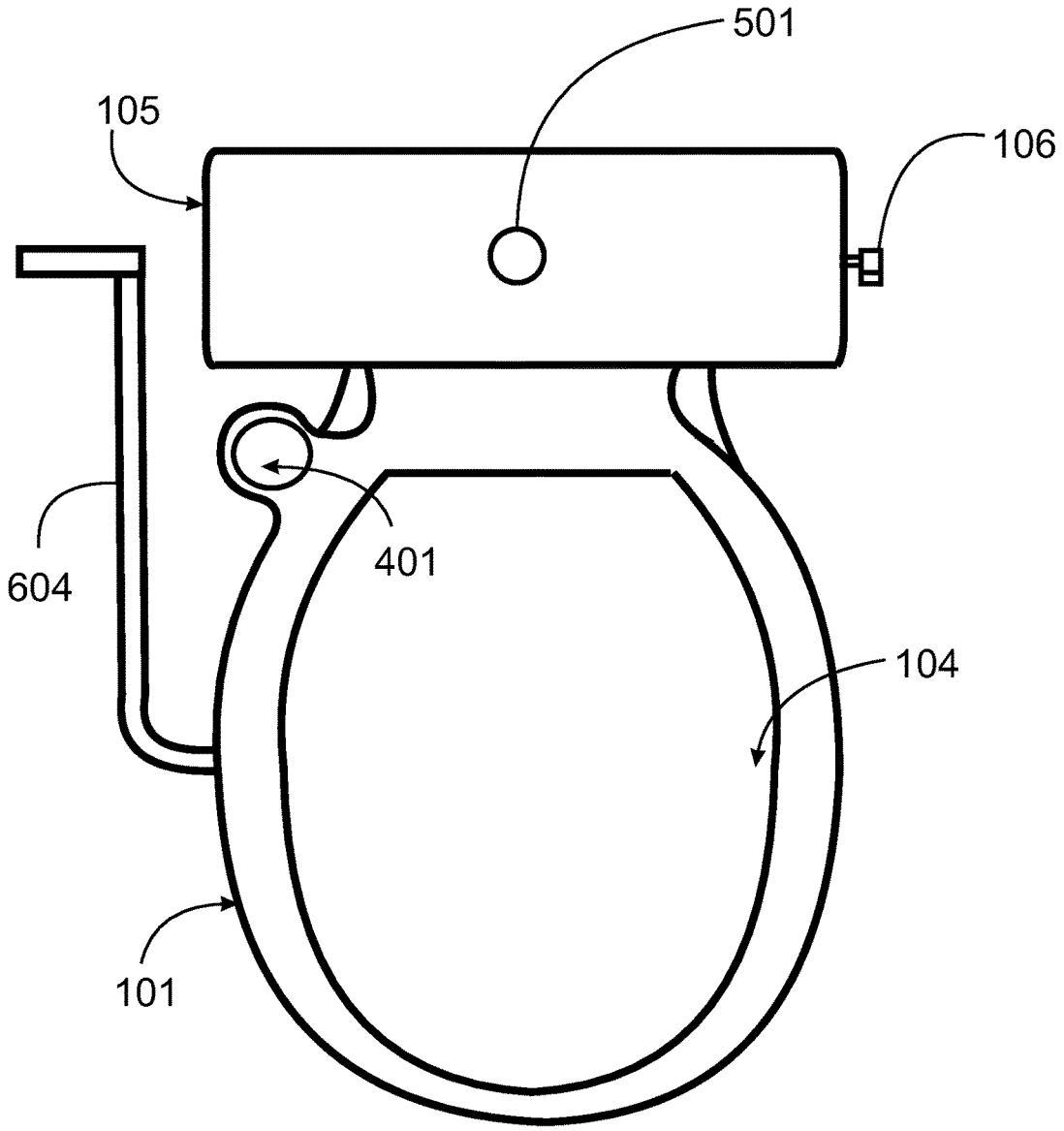
FIG. 9 is a top plan view of the toilet of FIGS. 6-8.

FIG. 8 is a front elevation view showing hand lever 604 on one side of the toilet, connected to the pivot to rotate bowl 601. FIG. 9 is a top plan view also showing hand lever 604. Hand lever 604 is shown on one side, but may be on either side, and two hand levers could be used in some embodiments.

In embodiments of the invention described above, a second bowl in addition to the conventional toilet bowl is described. In the embodiments above this second bowl is nested, at least in a default mode, within the outer conventional toilet bowl. This is not, however, a limitation of the invention. In some embodiments, a second bowl may be implemented to be off to one side of the conventional bowl in the default mode, or in front of the conventional bowl. These second bowls will have coupled mechanisms enabling contents to be dumped into the conventional bowl upon operation of the mechanisms.

Figure 10:
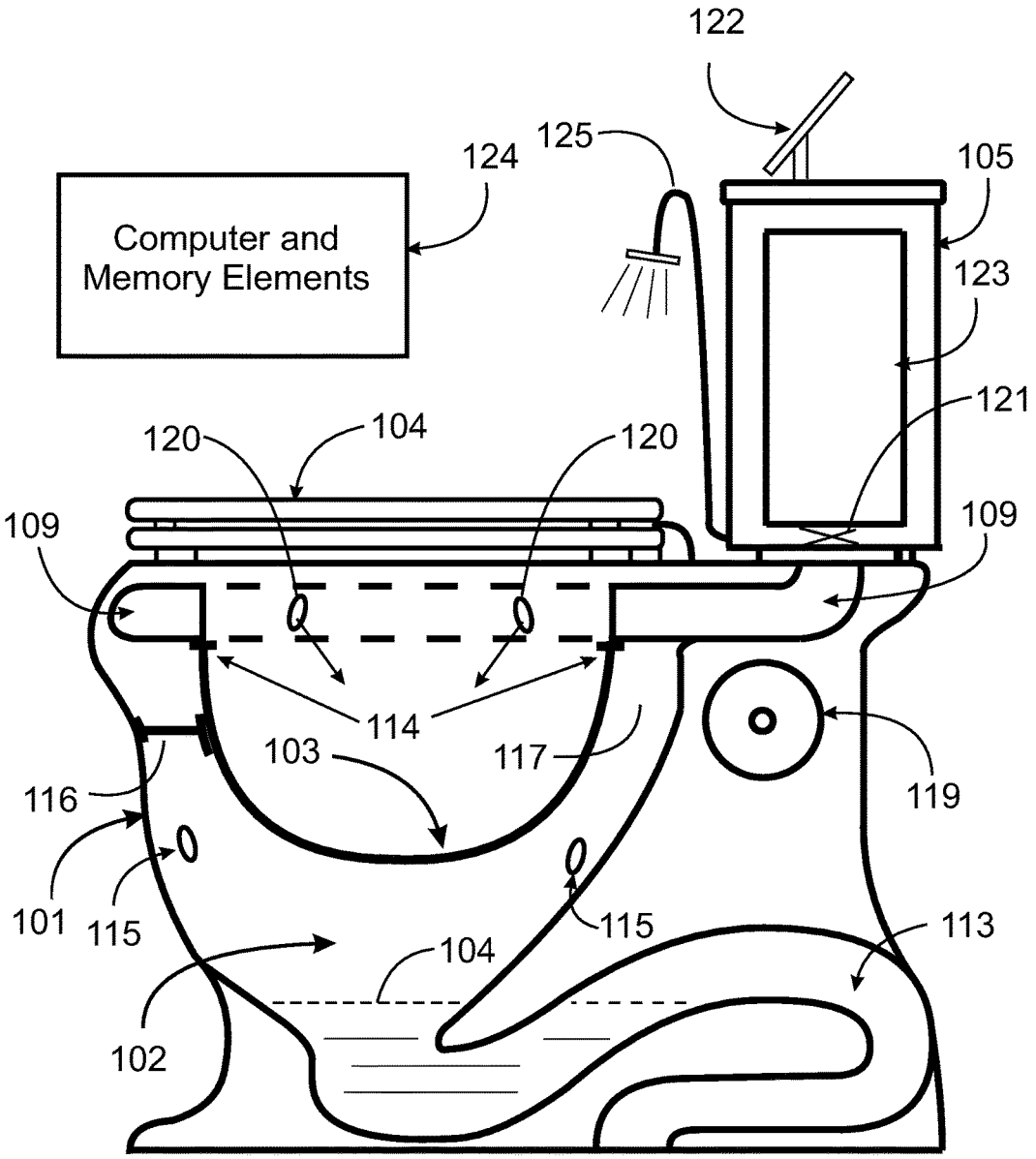
FIG. 10 is a side elevation view, partially in section, showing alternative elements and relationships in an alternative embodiment of the invention.

Within the broad concepts of the instant invention, there are many alternative features and details that might be implemented. Many of these alternative features are shown in FIG. 10, which is a side elevation view, partially in section, showing alternative elements and relationships that may be implemented in alternative embodiments of the invention.

In one alternative embodiment of the invention, as described above, and with further reference to FIG. 10, a dual-bowl toilet is provided, comprising a first bowl connected via one or more internal passages to one or more pressurized and automated water tanks 123 with manual override buttons that provide, when activated, water from the one or more pressurized tanks into the first and second bowl, one or more remotely-operable spray openings, such as openings 115 and 120, in various places, on and through an inner surface, spraying multidirectionally from fixed locations in both bowls, and a connected passage to a sewer line. There is in this alternative embodiment a second bowl, smaller than the first bowl, rotatable and joined to the first bowl, and operable by a user-controlled motor 119 in a manner that the second bowl maintains a resting, upright position with the bowl in a first position, or an inverted position facing downward into the first bowl, with a digital button, voice, or smartphone-activated motor, which may be triggered through an electrical and electronic control system, may be moved to a second position. Urine or feces in the second bowl at a time of activating the motor from the first position to the second position, as the second bowl is moved to the inverted position, is dropped into the first bowl, the second bowl, inverted, is spray-cleaned by operation of different ones of the spray openings, and the cleaned second bowl is returned to upright position by user controlled activation.

In one embodiment, the second bowl is suspended within the first bowl, both in upright and inverted position. Also in one embodiment, the second bowl is pivoted along a pivot axis from front to back, has an upper rim enabled to seal to inside an upper region of the first bowl by seal elements on one or both of the upper rim and the upper region, and a mechanical pivot mechanism operated by user-controlled motor 119 moves the second bowl to unseal from the upper region of the first bowl as the motor is operated before inverting the second bowl, and moves the second bowl to reseal to the upper region of the first bowl as the second bowl is returned by the electric motor-driven pivot mechanism to the upright position.

In one embodiment, the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl. Also in one embodiment, the second bowl is pivoted side-to-side and is operated by a motor to rotate the second bowl from an upright to an inverted position. And in one embodiment the toilet further comprises a button-controlled valve to add a small volume of water to the second bowl when the second bowl is in an upright position.

In one embodiment, a control system is included that may be operated from a flat touchscreen, using soft keys, such as screen 122 shown in FIG. 10. The screen may be an LCD screen with a selection of interactive icons activating computing options, similar to a smartphone. The screen may be on top of the water tank to control rotation of the second bowl, pre-filling of the second bowl, all flushing & cleaning options and voice-activation awakening or smartphone app parity. But the position on the tank is not limiting. The control screen may also be mounted on a wall next to the toilet, or across the room, or at any other convenient location, and may communicate with a control panel in or near the toilet by wireless technology, such as Bluetooth™.

In another alternative aspect of the invention, a method of conserving water use in a toilet is provided, comprising joining a second bowl rotatable and operable by a motor, to a first bowl connected via one or more internal passages to a pressurized water tank having an electronically-controlled valve 121 enabled to provide, when opened, water in the tank into the first bowl, one or more remotely-operable spray openings on and through an inner surface, with multidirectional facing, and a connected passage to a sewer line. The motor is operable from a first to a second position, moving the second bowl from a resting, upright position with the motor in a first position, to an inverted position facing downward into the first bowl, with the bowl moved to a second position, causing urine or feces in the second bowl to drop into the first bowl. The spray openings may be operated with the second bowl inverted, to clean the second bowl, and the second bowl is then returned to the resting, upright position by pressing a button on the control screen, smartphone app activation, or by a voice command to initiate the rotation to the first position.

In one embodiment, the method further comprises rotating the second bowl suspended within the first bowl, both in upright and inverted position. Also in one embodiment, the method further comprises sealing the second bowl by an upper rim to an upper region of the first bowl with the second bowl upright, unsealing the first bowl from the second with action of a pivot mechanism before rotating the second bowl, and resealing the second bowl to the first bowl when the second bowl is returned to the upright position. In one embodiment, the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl. Also in one embodiment, the method further comprises pivoting the second bowl from side-to-side.

In one embodiment, the method further comprises adding a small volume of water to the second bowl (pre-filling the second bowl before using) when the second bowl is in an upright position, by an electronically controlled valve with the aforementioned user interface options (Voice command, tank mounted touch screen, personal smartphone).

Also, in one embodiment, there is an external spraying device 125 holstered to the side of the water tank, or in another convenient position, and tethered to the tank via a hose, which may be used to deliver water to the spray nozzle. This sprayer is useful to spot clean either bowl should waste stick to the inner surfaces. This spray nozzle is similar to one found as an accessory on kitchen sink faucets or those used on bidet sprayers.

In some embodiments of the invention a computerized control system, having memory elements, is provided, along with sensors implemented in water tanks and passages in the toilet itself, with either wired or wireless communication, so a number of data saving and reporting functions may be accomplished. The usage of water over time for the toilet system may in this way be monitored and reported, and alerts may be provided, by such as the touchscreen described above, to inform a user as to success in water savings, and potential leaks and such. The control system may be operable in a variety of languages, selectable, in addition to English.

The concept, related to the various embodiments of the invention, of a small flush and a big flush, have been introduced above. Related to these concepts the following is added:

Flush types and related info:

1. Small flush controlled by manual valve or semi-automatic valve
2. Small flush controlled by automated, timed, or semi-automated valve
3. Small flush (automated) has start and reset function that the user may control through the computerized control system, and such as interactive interfaces on the touch-screen, either at the toilet, of in an app on a smart phone, for example.
4. Big Flush using one or two manually controlled pressurized water tanks actuated by a dual flush lever located on crank arm or buttons on top of toilet
5. Big flush using one or two semi-automated pressurized water tanks and bowl sprayers Pre-fill of second bowl prior to use:

In one embodiment, a hand crank lever that rotates the second bowl may have a flush mechanism attached in a way that a bicycle brake is attached to bike handle bars. This lever may facilitate a dual flush operation. This configuration will allow either the small flush to be initiated or the big flush function which consists of one or two pressurized tanks to be dispensed. Depending on the necessary strength and volume of flush.

In one embodiment, the toilet, either manually controlled or automated, may serve as a women's or men's (gender neutral) urinal. The first ever woman's urinal or gender neutral urinal.

Possible voice commands for an automated version:

"Toilet open"
"Toilet fill"
"Toilet small flush"
"Toilet big flush"
"Toilet clean"

In one embodiment integrated with smartphone or similar technology with LCD or LED screen display, the Screen presents user with buttons (interactive icons) labeled and functional as follows:

1. Pre-fill -before use
2. Small flush—start/stop
3. Big flush—1 tank
4. Big flush—2 tanks
5. Cleaning
6. Smartphone parity
7. Help
8. Statistics of water use
9. Maintenance info
10. Send use data to Each of the selections listed above is a trigger to a process that is further facilitated by interactive interfaces in a hierarchical manner.

It will be apparent to the skilled person that many of the details illustrated in the figures and described above might be accomplished in another way than that illustrated and described, but in most cases such differences will fall within the scope of the present invention.

The invention claimed is:

1. A dual-bowl toilet, comprising:

a first bowl having an upper rim and a lowermost depth, and a connected passage exiting the first bowl, allowing water to stand in the first bowl to the height of the entry of the passage, the first bowl connected via one or more internal passages to a water tank having a user-operable valve providing, when opened, a volume of water from the water tank into the first bowl, causing contents of the first bowl to flush to the passage and spray openings on and through an inner surface, opening into the first bowl, the spray openings directed generally upward; and a second bowl, smaller than the first bowl, rotatable and joined to the first bowl in a manner to be always above the height of the standing water in the first bowl, and rotatable by a user-operable mechanism in a manner that the second bowl maintains a resting, upright position until rotated by the user-operable mechanism to an inverted position facing downward into the first bowl;

wherein any content in the second bowl at a time of rotation from the resting, upright position to the inverted position, is dropped into the standing water of the first bowl, the second bowl, while inverted, is spray-cleaned by operation of the spray openings, and the cleaned second bowl is returned to upright position.

2. The dual-bowl toilet of claim 1 wherein the second bowl is suspended within the first bowl, both in upright and inverted position.

3. The dual-bowl toilet of claim 2 wherein the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl.

4. The dual-bowl toilet of claim 3 wherein the second bowl is pivoted side-to-side and is operated by a lever to rotate the second bowl from an upright to an inverted position.

5. The dual bowl toilet of claim 1 further comprising a user-operable valve enabled to add a small volume of water to the second bowl when the second bowl is in an upright position.

6. The dual-bowl toilet of claim 1 wherein the user-operable mechanism is one or both of a foot-operated or a hand operated lever, operable from one side or both sides of the toilet.

7. A method of conserving water use in a toilet, comprising:

joining a second bowl rotatable and operable by a user-operable mechanism, to a first bowl having an upper rim, and a connected passage exiting the first bowl, allowing water to stand in the first bowl to the height of the entry of the sewer line, the first bowl connected via one or more internal passages to a water tank having a user-operable valve enabled to provide, when opened, water in the tank into the first bowl, flushing contents in the first bowl into the passage, and one or more remotely-operable spray openings on and through an inner surface of the first bowl, directed generally upward;

operating the user-operable mechanism, rotating the second bowl from a resting, upright position, to an inverted position facing downward into the first bowl, causing contents in the second bowl to drop into the first bowl;

operating the spray openings with the second bowl inverted, cleaning the second bowl;

returning the second bowl to the resting, upright position by operating the user-operable mechanism.

8. The method of claim 7 further comprising rotating the second bowl suspended within the first bowl, both in upright and inverted position.

9. The dual-bowl toilet of claim 2 wherein the first bowl has a seal ring hinged to the first bowl at a hinge position common to a toilet seat and seat cover, the seal ring closing below the toilet seat with the second bowl in an upright position, providing a seal to an upper region of the first bowl and to an upper rim of the second bowl.

10. The method of claim 9 further comprising pivoting the second bowl from side-to-side.

11. The method of claim 7 further comprising adding a small volume of water to the second bowl when the second bowl is in an upright position, by a user-operable valve.

12. The method of claim 7 comprising implementing the user-operable mechanism as one or both of a foot-operated or a hand operated lever, operable from one side or both sides of the toilet.

* * * * *